US006227983B1

(12) United States Patent
Yang

(10) Patent No.: US 6,227,983 B1
(45) Date of Patent: May 8, 2001

(54) GOLF CLUB HEAD AND LASER POINTER ARRANGEMENT

(76) Inventor: Jui Jen Yang, 3r 2th Floor, No. 6, Ta-An West St., Taichung (TW)

( * ) Notice: Subject to any disclaimer, the term of this patent is extended or adjusted under 35 U.S.C. 154(b) by 0 days.

(21) Appl. No.: 09/433,641

(22) Filed: Nov. 3, 1999

(51) Int. Cl.[7] ..... A63B 69/36
(52) U.S. Cl. ..... 473/220
(58) Field of Search ..... 473/220, 221; 362/259

(56) References Cited

U.S. PATENT DOCUMENTS 3,753,564 * 8/1973 Brandell ..... 473/220
5,839,969 * 11/1998 Klouda ..... 473/220
5,873,789 * 2/1999 Torriano ..... 473/220
5,951,149 * 9/1999 Lee ..... 362/359
5,980,393 * 11/1999 Molinaroli ..... 473/220

* cited by examiner

*Primary Examiner*—Mark S. Graham
*Assistant Examiner*—Raeann Gorden
(74) *Attorney, Agent, or Firm*—Pro-Techtor International Services

(57) ABSTRACT

A golf club head and laser pointer arrangement, which includes a golf club head, the golf club head having a recessed chamber and an elongated slot on a face thereof in communication with the recessed chamber, and a laser pointer mounted in the recessed chamber, the laser pointer having a laser firing hole, a lens mounted in the laser firing hole, and a laser diode and driver circuit controlled to emit a laser beam through the lens and the elongated slot on the face of the golf club head for pointing the ball toward the target hole in a golf course.

7 Claims, 4 Drawing Sheets

GOLF CLUB HEAD AND LASER POINTER ARRANGEMENT

BACKGROUND OF THE INVENTION

The present invention relates to a golf club head, and more particularly to a golf club head and laser pointer arrangement, in which a laser pointer is mounted in a recessed chamber in a golf club head, and controlled to emit a laser beam for pointing the ball toward the target hole.

The game of golf has become more and more popularly accepted. However, it is not easy to a beginner to drive or put the ball into the hole. A beginner may need a coach to teach driving the ball with the club.

SUMMARY OF THE INVENTION

The present invention has been accomplished under the circumstances in view. According to the present invention, a golf club is equipped with a laser pointer, so that the user can aim the ball at the hole accurately by means of the guide of the laser beam from the laser pointer. According to one aspect of the present invention, the golf club head has a recessed chamber and an elongated slot on the face thereof, and a laser pointer is mounted in the recessed chamber and controlled to emit a laser beam through the elongated slot. According to another aspect of the present invention, the laser pointer can be rotated in the recessed chamber, and positioned in one of a series of angular positions within a limited range.

DETAILED DESCRIPTION OF THE PREFERRED EMBODIMENT

Figure 1:
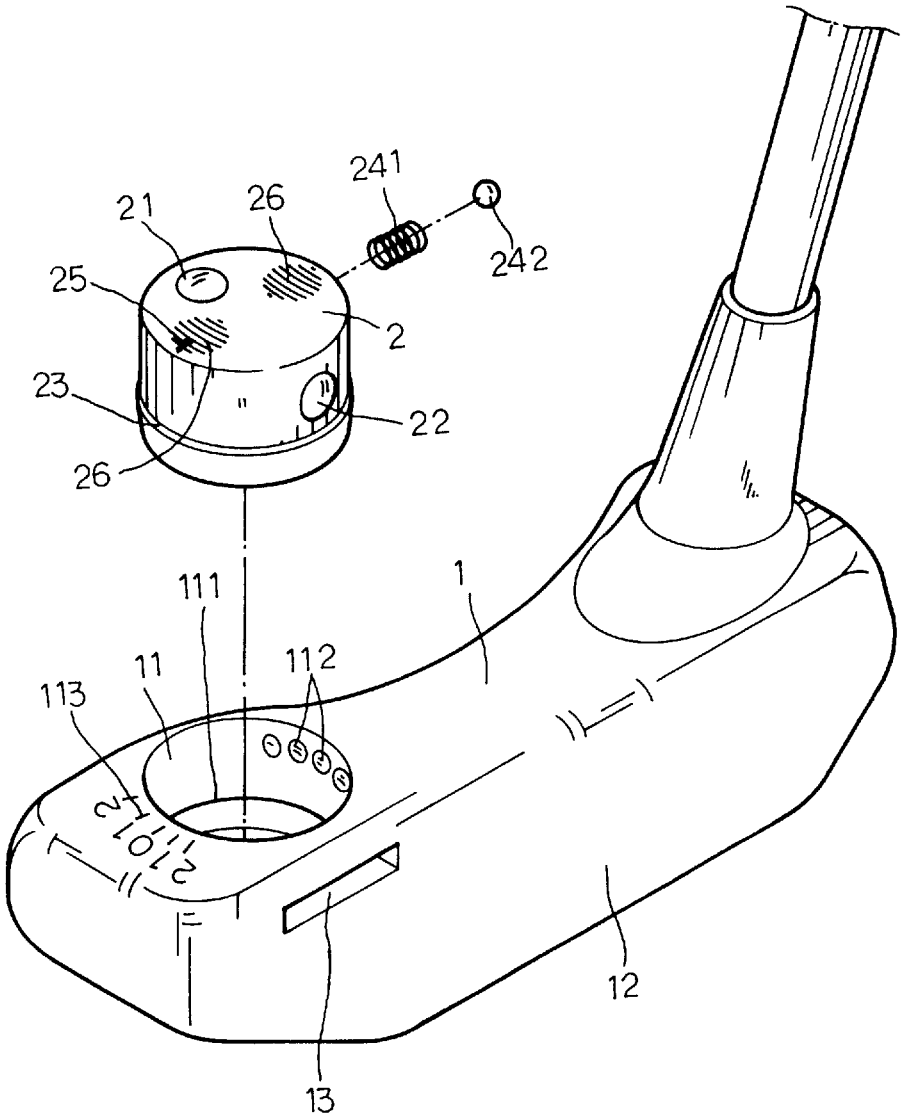
FIG. 1 is an exploded view of the preferred embodiment of the present invention.
Figure 2:
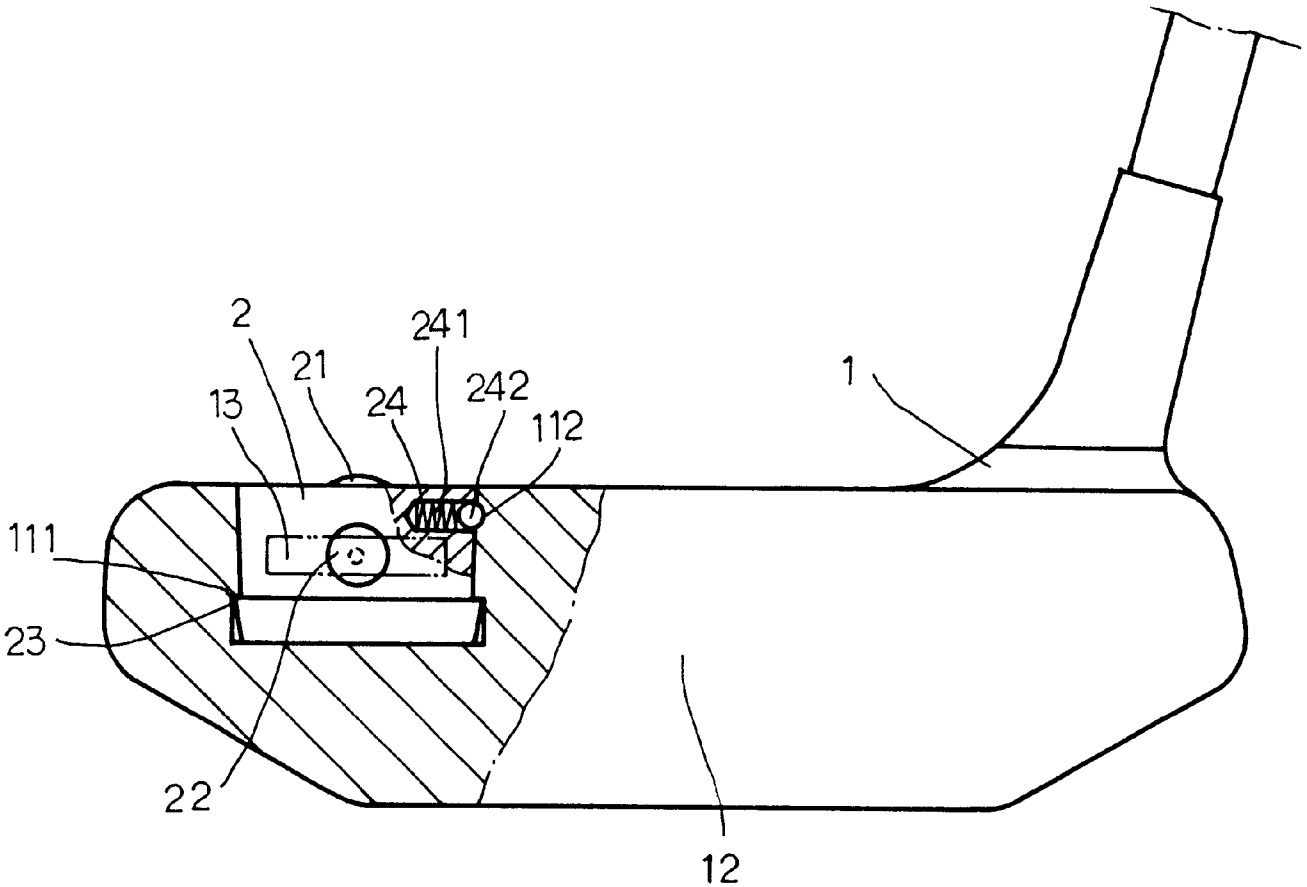
FIG. 2 is a sectional view of the present invention, showing the laser pointer installed in the recessed chamber in the head of the golf club.

Referring to FIGS. 1 and 2, the head 1 of a golf club is shown having a circular recessed chamber 11 on a topside wall thereof, and an elongated slot 13 on the face 12 thereof in communication with the recessed chamber 11. A circular laser pointer 2 is mounted in the recessed chamber 11. The laser pointer 2 comprises a laser diode and driver circuit (not shown), an on/off switch 21 disposed at the topside thereof, a lens 22 mounted in a laser-firing hole thereof. The laser diode of the laser diode and driver circuit is aimed at the lens 22.

Figure 4:
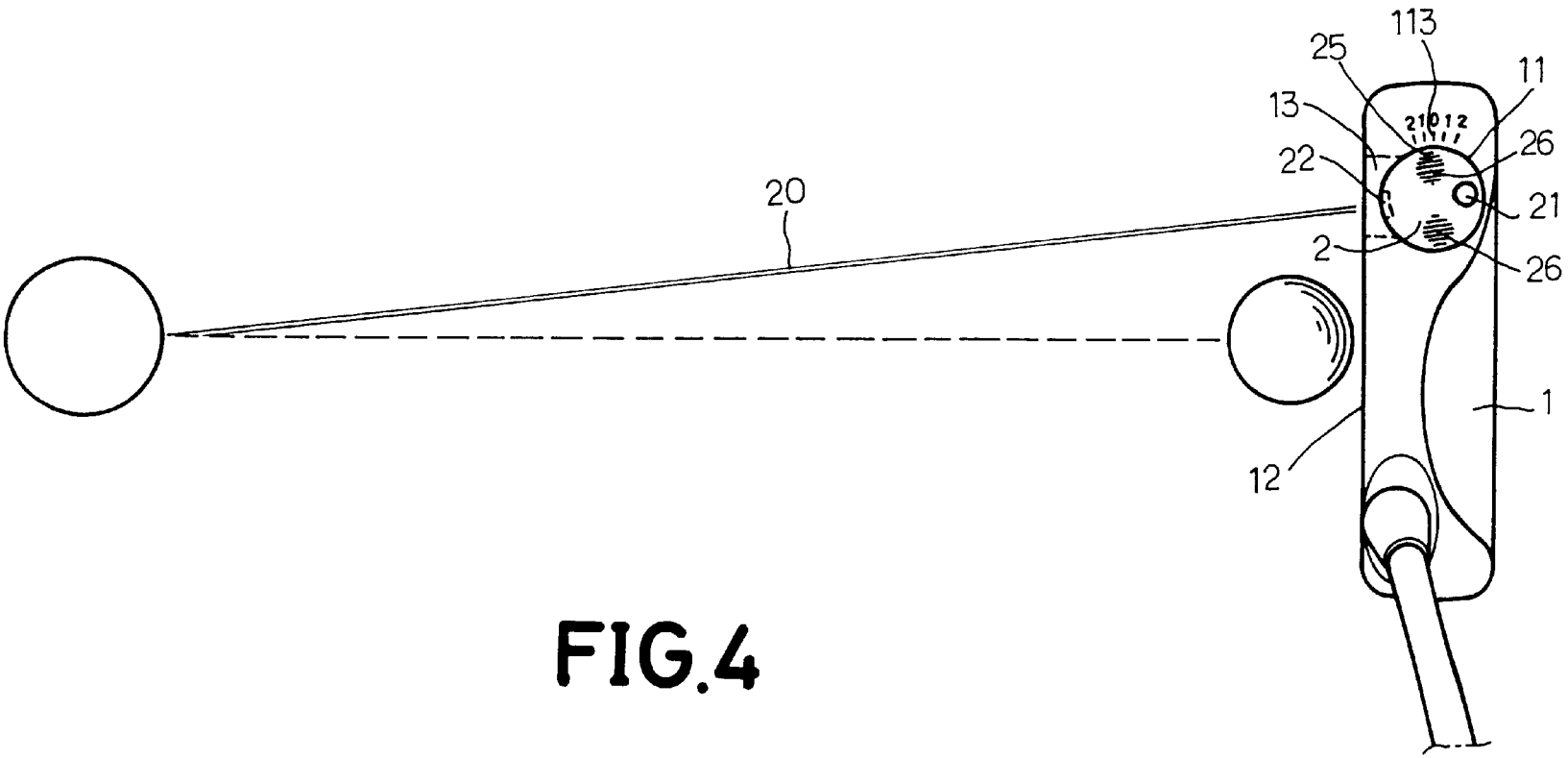
FIG. 4 is a schematic drawing showing an application example of the present invention.

Referring to FIG. 4 when the on/off switch 21 is switched on, the laser diode is driven to emit a laser beam 20 through the lens 22 and the elongated slot 13 to point the ball toward the hole.

Referring to FIGS. 1 and 2 again, an inside annular groove 111 is provided around the peripheral wall of the recessed chamber 11. The laser pointer 2 comprises an outside annular flange 23 raised around the periphery. After insertion of the laser pointer 2 in the recessed chamber 11, the outside annular flange 23 is forced into engagement with the inside annular groove 111 inside the recessed chamber 11, enabling the laser pointer 2 to be rotated in the recessed chamber 11 stably. Alternatively, the laser pointer 2 may be pivotally fastened to the bottom sidewall of the recessed chamber 11 by a rivet.

Referring to FIGS. 1 and 2 again, a blind hole 24 is formed on the periphery of the laser pointer 2 to hold a compression spring 241 and a steel ball 242 on the compression spring 241. The compression spring 241 imparts an outward pressure to the steel ball 242, causing a part of the steel ball 242 to project out of the periphery of the laser pointer 2. A series of recessed holes 112 are equiangularly arranged around the peripheral wall of the recessed chamber 11 at same elevation corresponding to the steel ball 242 at the laser pointer 2. After installation of the laser pointer 2 in the recessed chamber 11, the steel ball 242 is engaged into one recessed hole 112 to hold the laser pointer 2 in position.

Figure 3:
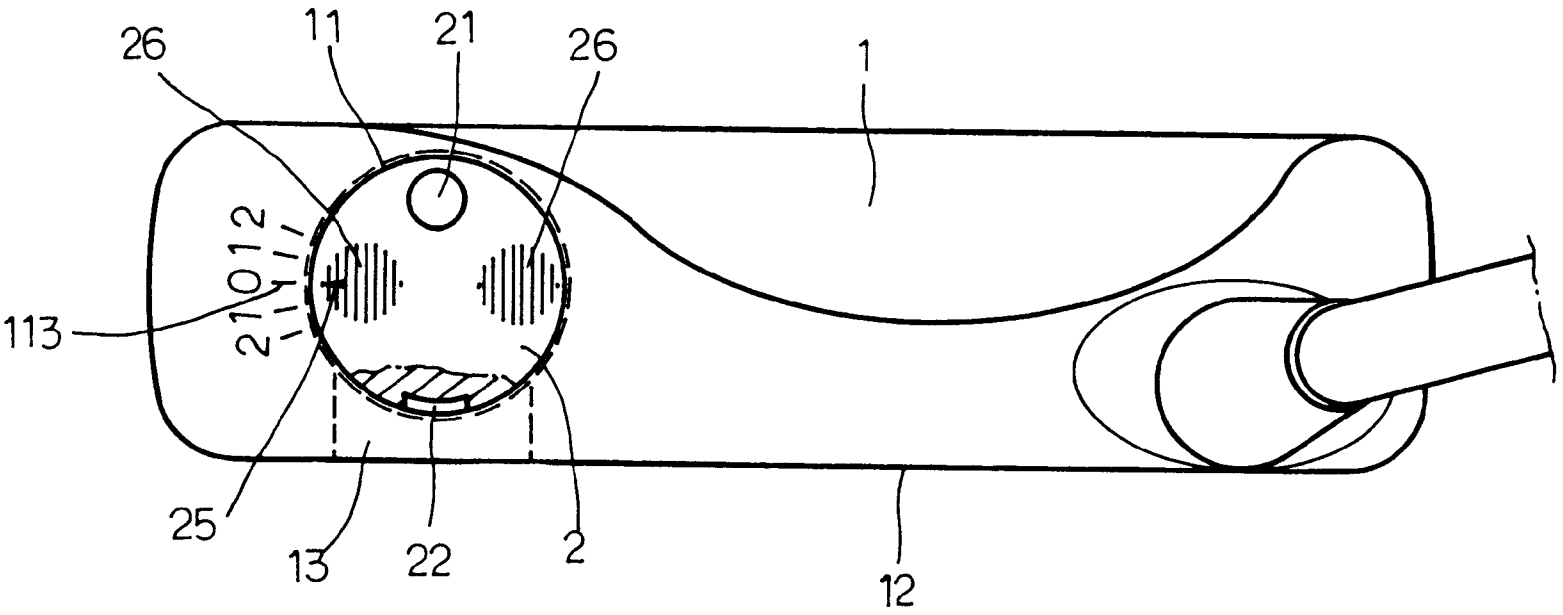
FIG. 3 is a top plain view of FIG. 2.

Referring to FIGS. 1 and 3 again, graduations 113 are made on the top side wall of the head 1 around the recessed chamber 11 corresponding to the recessed holes 112, and an index 25 is marked on the top side wall of the laser pointer 2 corresponding to the graduations 113. Further, embossed portions 26 are provided at the topside wall of the laser pointer 2 for the positioning of the finger for enabling the laser pointer 2 to be positively rotated in the recessed chamber 11.

It is to be understood that the drawings are designed for purposes of illustration only, and are not intended for use as a definition of the limits and scope of the invention disclosed. For example, the laser pointer 2 can be fixedly mounted in the recessed chamber 11 in the head 1. In this case, the aforesaid embossed surface portions 26, graduations 113, recessed holes 112, blind hole 24, compression spring 241, and steel ball 242 are eliminated.

What the invention claimed is:

1. A golf club head and laser pointer arrangement comprising:

a golf club head including a striking face, said golf club head comprising a recessed chamber and an elongated slot on the striking face thereof in communication with said recessed chamber; and a laser pointer mounted in said recessed chamber, said laser pointer comprising a laser firing hole, a lens mounted in said laser firing hole, and a laser diode and driver circuit controlled to emit a laser beam through said lens and the elongated slot on the striking face of said golf club head toward a target selected by a user.

2. The golf club head and laser pointer arrangement of claim 1 wherein said golf club head comprises an annular groove disposed around the periphery of said recessed chamber, and said laser pointer comprises an outside annular flange raised around the periphery thereof and engaged into the annular groove in said recessed chamber for enabling said laser pointer to be rotated in said recessed chamber.

3. The golf club head and laser pointer arrangement of claim 2 wherein said golf club head comprises a plurality of recessed holes equiangularly spaced around a periphery of said recessed chamber, and said laser pointer comprises a blind hole on the periphery thereof, a compression spring being mounted in said blind hole, and a steel ball supported on said compression spring and forced by said compression spring into engagement with one of said recessed holes in said recessed chamber.

4. The golf club head and laser pointer arrangement of claim 3 wherein said golf club head comprises graduations marked on the top side wall thereof around said recessed chamber corresponding to said recessed holes, and said laser pointer has an index marked on a top side wall thereof and aimed at said graduations.

5. The golf club head and laser pointer arrangement of claim 4 wherein said laser pointer comprises a plurality of embossed surface portions on the top side wall thereof for the positioning of the finger for enabling said laser pointer to be rotated with the finger in said recessed chamber.

6. The golf club head and laser pointer arrangement of claim 1 wherein said laser pointer comprises an on/off switch on a top side wall thereof to switch on/off said laser diode and driver circuit.

7. The golf club head and laser pointer arrangement of claim 1 wherein said laser pointer is fixedly fastened to the inside of said recessed chamber by fastening means.

* * * * *